United States Patent [19]

Tanaka et al.

[11] Patent Number: 4,698,463

[45] Date of Patent: Oct. 6, 1987

[54] REMOTE-CONTROL SWITCH FOR MOTOR-DRIVEN AUTOMOTIVE MIRROR

[75] Inventors: Morimasa Tanaka, Atsugi; Tatsuo Kyoden, Isehara, both of Japan

[73] Assignee: Ichikoh industries Limited, Tokyo, Japan

[21] Appl. No.: 894,124

[22] Filed: Aug. 7, 1986

[30] Foreign Application Priority Data

| | | | |
|---|---|---|---|
| Dec. 25, 1985 | [JP] | Japan | 60-290430 |
| Dec. 25, 1985 | [JP] | Japan | 60-290431 |
| Dec. 25, 1985 | [JP] | Japan | 60-290432 |
| Dec. 25, 1985 | [JP] | Japan | 60-290433 |

[51] Int. Cl.[4] ..... H01H 9/00; H01H 13/70

[52] U.S. Cl. ..... 200/5 R; 200/16 D; 200/18

[58] Field of Search ..... 200/1 R, 4, 5 R, 5 A, 200/6 A, 16 C, 16 D, 17 R, 18, 153 K; 350/637

[56] References Cited

U.S. PATENT DOCUMENTS

| | | | |
|---|---|---|---|
| 813,682 | 12/1985 | Tanaka et al. . | |
| 4,330,694 | 5/1982 | Ogawa | 200/6 A |
| 4,428,649 | 1/1984 | Main et al. | 200/5 R X |
| 4,476,356 | 10/1984 | Nakayama et al. | 200/153 K X |
| 4,499,342 | 2/1985 | Nakayama | 200/5 R X |
| 4,590,338 | 5/1986 | Suzuki | 200/5 R |
| 4,611,102 | 9/1986 | Ishida | 200/5 R |

FOREIGN PATENT DOCUMENTS 58-40451 9/1956 Japan .

*Primary Examiner*—J. R. Scott

*Attorney, Agent, or Firm*—Schwartz, Jeffery, Schwaab, Mack, Blumenthal & Evans

[57] ABSTRACT

A control switch for remote-controlling a motor-driven automotive mirror. The stationary contact to be connected to one of the terminals of the motor to move the mirror about a vertical axis, the stationary contact to be connected to one of the terminals of the motor to move the mirror about a horizontal axis, and the stationary contact to be connected to the other terminal of the above two motors in common are formed on a circuit board. Bridge members connect each of the stationary contacts selectively to one of the stationary contacts of a stationary contact pair. The bridge members to connect stationary contacts to the negative polarity of a power supply at their ordinary position and to the positive polarity at their actuated position are accommodate in an enclosure fixedly attached to the circuit board. The actuating rods to act on the bridge members are arranged in the enclosure to be independent of one another, and one end of each of the actuating rods is projecting outside from the enclosure. The projecting ends of the actuating rods are related to the four mirror-moving-direction-indicating portions of a push-plate, and as one of the direction-indicating portions of the push-plate is depressed, the related actuating rods cause the bridge members to act for a switching operation.

8 Claims, 13 Drawing Figures

| | Contact | U | D | L | R |
|---|---|---|---|---|---|
| Left-side Mirror | 50 | ⊖ | ⊕ | ⊖ | ⊕ |
| | 64 | ⊖ | ⊕ | ⊕ | ⊖ |
| | 63 | ⊕ | ⊖ | ⊖ | ⊕ |
| Right-side Mirror | 50 | ⊖ | ⊕ | ⊖ | ⊕ |
| | 66 | ⊖ | ⊕ | ⊕ | ⊖ |
| | 65 | ⊕ | ⊖ | ⊖ | ⊕ |

| | Contact | U | D | L | R |
|---|---|---|---|---|---|
| Left-side Mirror | 50 | ⊖ | ⊕ | ⊖ | ⊕ |
| | 64 | ⊖ | | ⊕ | ⊖ |
| | 63 | ⊕ | ⊖ | ⊖ | |
| Right-side Mirror | 50 | ⊖ | ⊕ | ⊖ | ⊕ |
| | 66 | ⊖ | | ⊕ | ⊖ |
| | 65 | ⊕ | ⊖ | ⊖ | |

REMOTE-CONTROL SWITCH FOR MOTOR-DRIVEN AUTOMOTIVE MIRROR

BACKGROUND OF THE INVENTION (a) Field of the Invention:

The present invention relates to a switch for remote-controlling the motions about a vertical axis and horizontal axis of the reflective face of a motor-driven mirror installed on an automobile.

(b) Related Art Statement:

A remote-controlled motor-driven automotive mirror device has in the mirror housing the motors which are adapted to rotate the mirror surface about the vertical and horizontal axes, respectively. The mirror surface of either of the right and left mirrors of the automobile is moved about the vertical axis and horizontal axis by rotating in the forward or reverse direction the motors which correspond to the axial moves, respectively. The forward and reverse rotations of such motors are controlled by means of a control switch provided between the motors and a direct-current power source for energizing the motors, namely, a battery, and a switching circuit to tilt desired one of the mirrors in a desired direction. Such control switch is equipped with a manipulating switch to alternatively rotate the mirror surface about the vertical axis and horizontal axis and a bidirectional changeover switch to select either one of the right and left mirrors of the automobile to be moved, and is located near the driver's seat in the automobile for the driver to operate it by touching it by his or her finger.

For example, a mirror surface tilting device comprising such a control switch as above is disclosed in Japanese Unexamined Utility Model Publication No. 58-40451.

The control switch comprises a push-plate provided as exposed in an opening at the top of a box-shaped casing that is rectangular in the cross-sectional shape, a plurality of stationary contacts formed on a circuit board, and a pair of arc-shaped bridge members provided between the push-plate and circuit board, made of an electrically conductive elastic substance and arranged in parallel for selectively connecting specific ones of the plurality of stationary contacts on the circuit board. The push-plate has on its front surface four pressing positions, U, D, R and L, in correspondence to the upward, downward, rightward and leftward directions in which the mirror surface will be tilted, and has on its back surface four projections touching the circumferential face near both ends of a pair of bridge members, respectively, the pair of bridge members movably supporting the push-plate. When one of the pressing positions of the push-plate is depressed, two of the four projections press in relation to the depressed position both ends of one of the paired bridge members or one end of both of the paired bridge members, respectively, and the bridge member or members concerned are elastically deformed. At that time, the end of the pressed side of bridge member slides in the direction toward the other end of the bridge member to connect specific stationary contacts each other. Thus a switching operation is effected by depressing one of the pressing positions on the push-plate, and a specific motor is thereby rotated to tilt the mirror in the direction corresponding to the depressed position of the push-plate.

A conventional control switch as described above makes a selective connection between stationary, contacts, namely, a switching operation, by letting the projections integrally formed on the back of a push-plate press the circumferential face of one or both of two paired bridge members for thereby elastically deforming the bridge member or members concerned. The switching operation is conducted by the driver depressing the push-plate by his or her finger, and because the push-plate itself acts on the bridge member or members, the switching touch felt by the driver is not light but heavy, posing a problem in operability. There also is a problem that the depressing pressure felt by the driver varies depending on the depressed position of the push-plate. Heavy touch and variable depressing pressure in such mechanical switching give a psychologically uneasy feel to the driver, and unnecessary attention may be concentrated by the driver on the control switch at the time of the switching operation; therefore, a control switch of light touch and uniform depressing pressure is demanded.

Further, since the entirety of the push-plate moves up and down with respect to the outer casing which defines the switch unit, there are clearances between the push-plate and outer casing to let the push-plate move smoothly, and there is an opening in the center of the push-plate through which the upper portion of the knob to manipulate a bidirectional changeover switch is inserted; therefore, it is deemed that dust, beverage and other foreign objects possibly enter through the clearances and opening from outside the control switch unit into the inside of the switch unit in which there are pluralities of stationary contacts and bridge members, adhere to the stationary contacts and the slide contacts of the bridge members in the portions where they touch each other, and hinder the bridge members from smoothly moving and/or cause them to be in poor contact with the stationary contacts.

SUMMARY OF THE INVENTION

An object of the present invention is to provide a control switch for remote-controlling a motor-driven automotive mirror which is so excellent in operability that the driver feels a substantially uniform depressing pressure when pressing any one of the pressing positions of the control switch and that the driver can operate the control switch with a light touch feeling.

Another object of the present invention is to provide a control switch for remote-controlling a motor-driven automotive mirror the switching members of which are free from the mobility hindrance and poor contact due to the entry of dust, beverage and other substances into the switch unit.

Still another object of the present invention is to provide a control switch for remote-controlling a motor-driven automotive mirror which is provided with a control circuit for accurate switching performance.

The above and other objects of the present invention will be better understood by reading the following more detailed description taken with the accompanying drawings.

BRIEF DESCRIPTION OF THE DRAWINGS

FIG. 1 is a perspective view showing the whole of the control switch, FIG. 2 is a schematic exploded perspective view showing the control switch with the contacts on its circuit board omitted, FIG. 3 is a schematic perspective view showing the positional relations of the stationary contacts and bridge members on the circuit board, FIG. 4 is a cross-sectional view of the control switch taken along the IV—IV line in FIG. 1, FIG. 5 is a cross-sectional view of the control switch taken along the V—V line in FIG. 1, FIG. 6 is a rear view showing the inner casing of the control switch, FIG. 7 is a schematic circuit diagram showing the control circuit used with the control switch, FIG. 8 is a top view showing part of the control circuit formed on the circuit board, and FIGS. 9 and 10 are cross-sectional views of the control switch illustrating operations of the control switch, and FIG. 11 is a table showing effects of the control circuit;

DETAILED DESCRIPTION OF THE PREFERRED EMBODIMENTS

Figure 1:
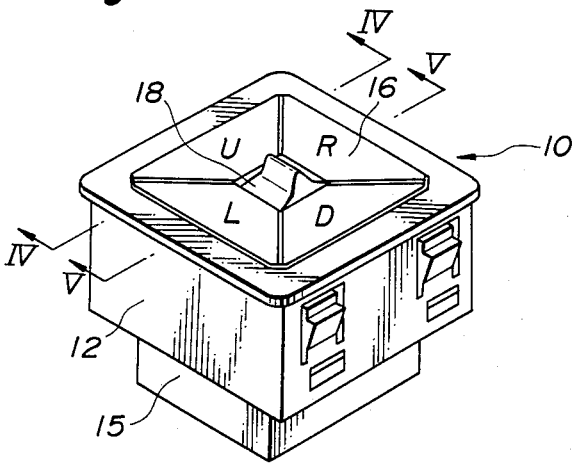
FIGS. 1 to 11 show a control switch preferably embodied according to the present invention
Figure 3:
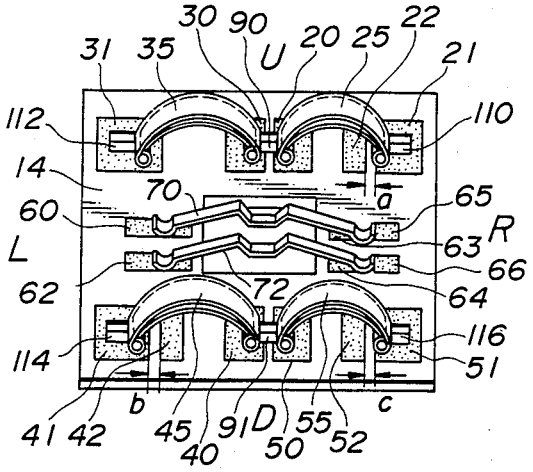

FIG. 1 shows an overall view of a control switch according to the present invention, reference numeral 10 denoting the whole of the control switch and reference numeral 12 denoting the outer casing of the control switch. The control switch 10 is devised to be located near the driver's seat in an automobile for the driver to remote-control from the driver's seat the direction of the reflective surface of the remote-controllable motor-driven mirrors installed on the right and left sides of the automotive body. The outer casing 12 is formed to be a rectangular parallelepiped having an opening at both ends, and a circuit board 14 on which groups of stationary contacts to be described later are mounted is provided inside the outer casing 12. The circuit board 14 is fixed to a holder 15, and the holder 15 is fitted to the outer casing 12.

The control switch 10 has a switch-manipulating part as exposed in the top opening 13 of the outer casing 12, the part being in the form of a push-plate having the direction-indicating portions provided for corresponding to the four directions of remote-controlled mirror motions, namely, upward, downward, rightward and leftward directions, respectively, and also has a changeover switch 18 to select either one of the mirrors located on the right and left sides of the automotive body, the changeover switch 18 being in the form of a knob externally projecting out of a center opening 17 of the push-plate 16. The four direction-indicating portions of the push-plate 16 are marked U, D, R and L, respectively, as in FIG. 1. A switching mechanism and control circuit to let a mirror-driving motor rotate in the direction corresponding to the direction-indicating portion depressed by the driver, of the push-plate 16 are provided inside the control switch 10. Further details will be described below.

Figure 13:
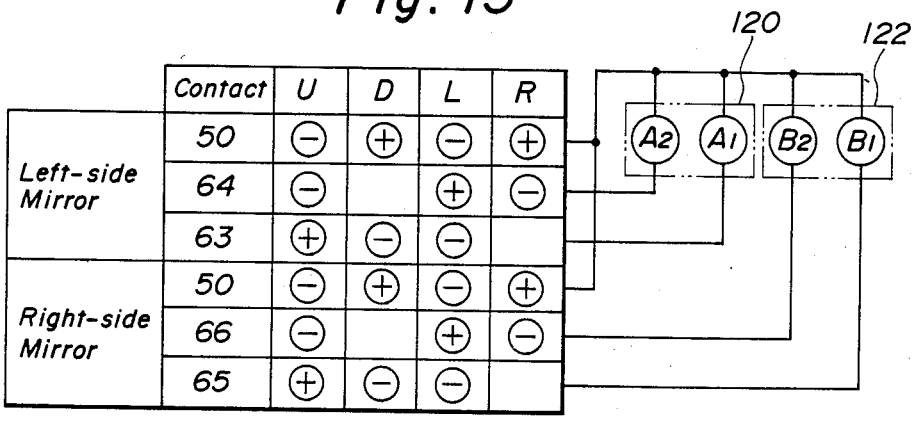
FIG. 13 is a table showing effects of the control circuit shown in FIG. 12.

FIG. 13 illustrates the positional relations of a plurality of stationary contact groups formed on the circuit board 14 and the bridge members arranged in correspondence to the contact groups.

The circuit board 14 is formed to be nearly rectangular, its top side corresponds to the U-marked direction-indicating portion of the push-plate 16, and its bottom, right and left sides correspond to the D-, R- and L-marked portions, respectively. In a place along the top side, a stationary contact 20 and a pair of stationary contacts 21 and 22 corresponding to the stationary contact 20 are located in a state of occupying about a half of the top side. A bridge member 25 to connect the stationary contact 20 to either one of the paired stationary contacts 21 and 22 is provided, ordinarily connecting the stationary contact 20 to the stationary contact 21. A stationary contact 30 is provided at a place adjacent to the stationary contact 20, a stationary contact 31 is further provided, and a bridge member 35 connects the stationary contacts 30 and 31 to each other. The stationary contacts 30 and 31 are electrically independent of other stationary contacts and a power source, forming a control circuit. Similarly, in a place along the bottom side of the circuit board 14, a stationary contact 40 and the paired stationary contacts 41 and 42 corresponding to the stationary contact 40 are provided in a state of occupying about a half of the bottom side, and a bridge member 45 if further provided so as to ordinarily connect the stationary contacts 40 and 41 each other. At a place adjacent to the stationary contact 40, a stationary contact 50 is provided. A pair of stationary contacts 51 and 52 is provided in correspondence to the stationary contact 50, and a bridge member 55 is further provided so as to ordinarily connect the stationary contacts 50 and 51 each other.

The stationary contact 20, paired stationary contacts 21 and 22, stationary contact 40, paired stationary contacts 41 and 42, stationary contact 50, paired stationary contacts 51 and 52, and bridge members 25, 45 and 55 compose a switching mechanism to rotate the mirrors upward, downward, rightward and leftward, and the distance a between the paired stationary contacts 21 and 22, the distance b between the paired stationary contacts 41 and 42 and the distance c between the paired stationary contacts 51 and 52 are set for the distances to be $c<a$ and $c<b$.

The edge on the stationary contact 21 side of the bridge member 25, the edge on the stationary contact 31 side of the bridge member 35, the edge on the stationary contact 41 side of the bridge member 45 and the edge on the stationary contact 51 side of the bridge member 55 substantially define a rectangle.

At positions across an opening 57 provided in the center of the circuit board 14, a stationary contact 60 and stationary contacts 63 and 65 are provided, and a slide member 70 is provided at a position parallel to the top or bottom side of the push-plate 16 so as to selectively connect the stationary contact 60 to the stationary contact 63 or 65. Similarly, a stationary contact 62 and stationary contacts 64 and 66 are provided, and a slide member 72 is provided to correspond to the stationary contacts 62, 64 and 66. These stationary contacts 60, 62, 63, 64, 65 and 66 and slide members 70 and 72 compose a switching mechanism for selecting either one of the right and left automotive mirrors in order to move the mirror thus selected.

Each of the bridge members 25, 35, 45 and 55 is made of an electrically conductive elastic substance of about the same size, both ends of which are formed into a round slide contact, respectively, and an auxiliary leaf spring is provided on the inner side of the bridge member for reinforcing the elasticity of the bridge member.

Each of the slide members 70 and 72 is made of an electrically conductive elastic substance provided with a slice contact at either end and is formed to be a switching member of the changeover switch 18 as will be described later, and both of the slide members 70 and 72 are supported by a slider 154 so as to be integrally moved.

Figure 6:
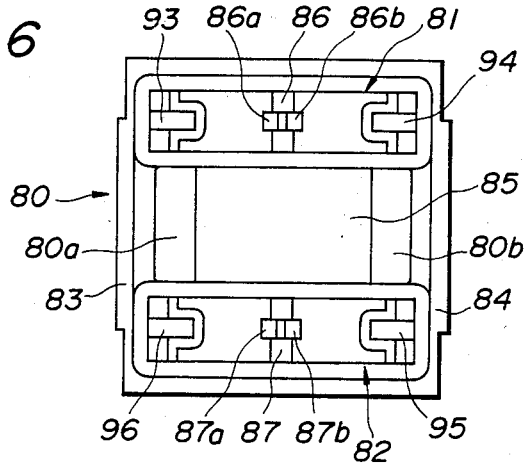

An inner casing 80 provided with an enclosed space for containing the above-mentioned bridge members between the aforementioned circuit board 14 and the inner casing is fixedly supported by the circuit board 14. The inner casing 80 is provided with a box-shaped member 81 to contain the bridge members 25 and 35 and a box-shaped member 28 to contain the bridge members 45 and 55, and both box-shaped members are located at parallel positions separate from each other. Each bridge member is contained in the corresponding box-shaped member in a state that the slide contacts of the bridge member are touched, to the circuit board 14. As shown in FIG. 6, the box-shaped member 81 has a partition wall 86 in the center in order to contain the bridge members 25 and 35 separately, and the box-shaped member 82 similarly has a partition wall 87 in the center in order to contain the bridge members 45 and 55 separately.

The partition wall 86 is provided with a tilted face **86*a* on the bridge member 25 side and a tilted face 86*b* on the bridge member 35 side. Similarly, the partition wall 87 is provided with tilted faces 87*a* and 87*b*. The tilted faces of the partition wall 86 are touched to the neighboring circumferential faces on the inner side of the bridge members 25 and 35, and the tilted faces of the partition wall 87 are touched to the neighboring circumferential faces on the inner side of the bridge members 45 and 55, the bottom end of the partition walls 86 and 87 being exposed in openings 90 and 91**, respectively.

Figure 2:
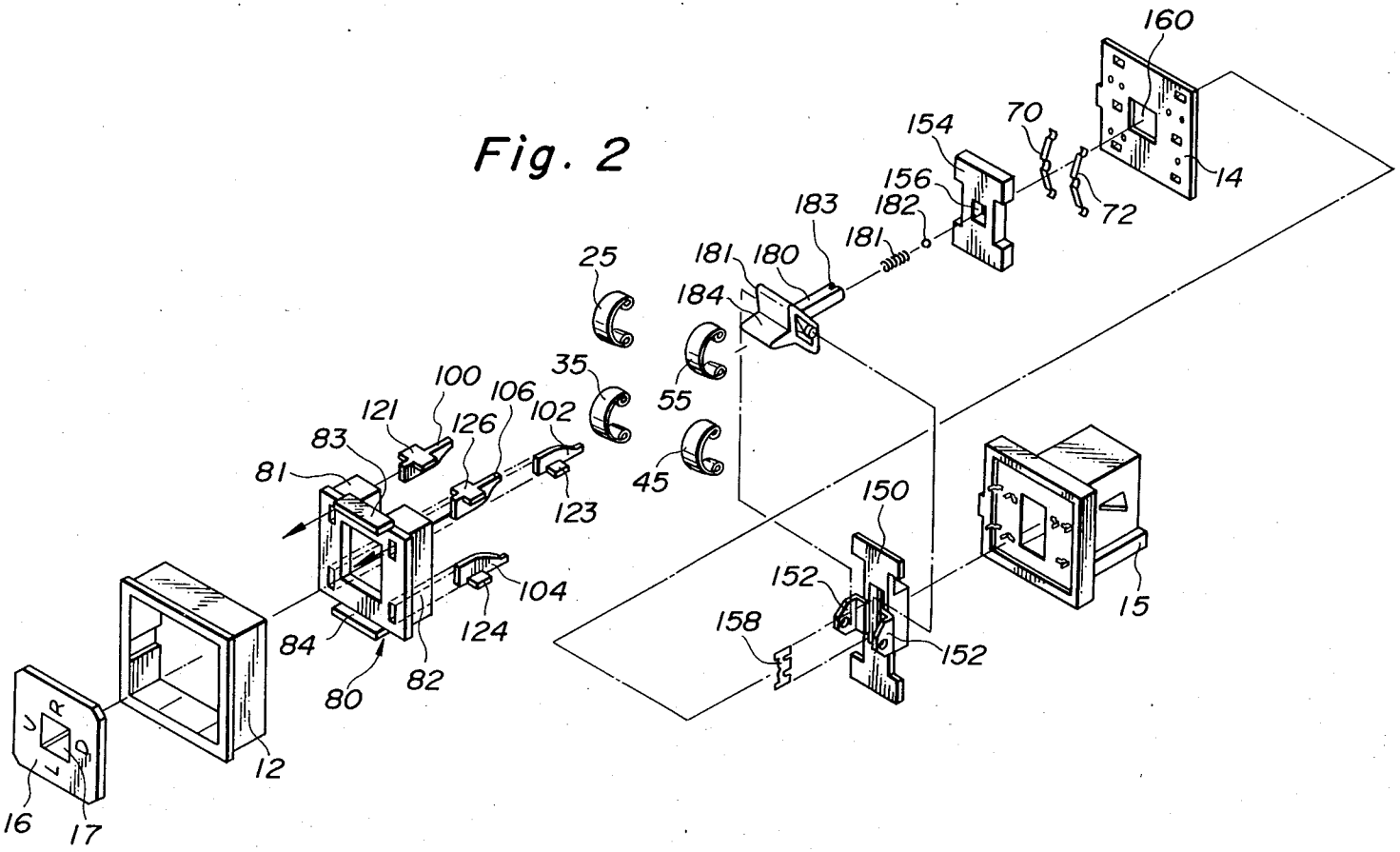
Figure 4:
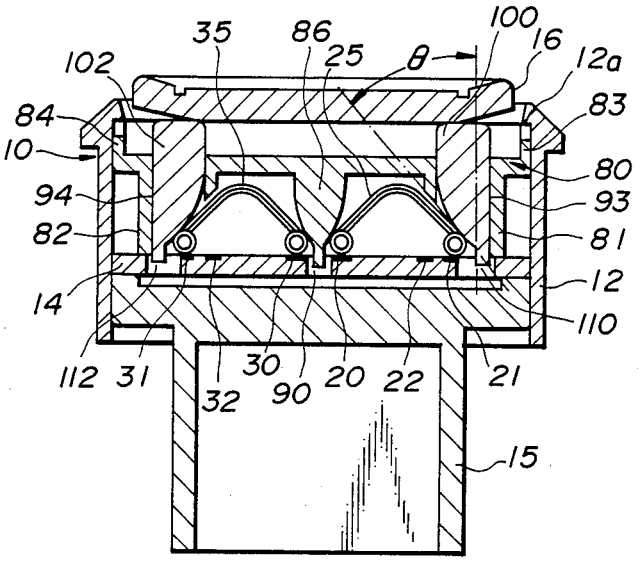

The box-shaped members 81 and 82 are provided with holes 93 and 94 and holes 95 and 96, respectively, near both ends. Through the holes 93 and 94 in the box-shaped member 81, actuating rods 100 and 102 formed so as to touch the circumferential face of the bridge members 25 and 35, respectively, on the stationary contact 21 and 31 side, are inserted respectively. Similarly, actuating rods 104 and 106 formed so as to touch the circumferential face of the bridge members 45 and 55, respectively, on the stationary contact 41 and 51 side are inserted through the holes 95 and 96, respectively, in the box-shaped member 82. Each of the actuating rods 100, 102, 104 and 106 is movably formed with respect to the inner casing 80. One end of each actuating rod is formed to be a tilted face which smoothly tilts inside the box-shaped member and is touched to the circumferential face near the slide contact of the corresponding bridge member, and the tip of that end is exposed in the corresponding one of the holes 110, 112, 114 and 116 formed in the circuit board 14. The other end of each actuating rod is extended to outside the inner casing 80, and this projecting end of the four actuating rods 100, 102, 104 and 106 supports the push-plate 16. For supporting the push-plate 16 in a horizontal state, it is necessary to keep all the actuating rods even in the projecting length; therefore, the four actuating rods are provided with stoppers 121, 123, 124 and 126, respectively, which touch the inner wall of the top of the corresponding box-shaped members 81 and 82. These stoppers are shown in FIG. 2.

The above-mentioned inner casing 80 containing the bridge members in the corresponding box-shaped members 81 and 82 has its bottom edges touched to the circuit board 14. The top end of the vertical walls 83 and 84 provided to oppose each other across a center opening 85 of the inner casing 80 is formed so as to engage with the bottom portion of the opening edge wall **12*a* which defines the opening 13 of the outer casing 12, by which the bottom edges of the box-shaped members 81 and 82 come into tight contact with the circuit board 14, the inner casing 80** forming an enclosure to contain the bridge members and stationary contacts within the enclosed space. The enclosure thus formed prevents dust, drink and other foreign substances from entering the control switch unit from outside and adhering between the slide contacts of bridge members and the corresponding stationary contacts to cause poor contact between the contacts.

The push-plate 16 is provided with a pair of perpendicular walls **16*a* and 16*b* on the back side of the L- and R-marked portions, the walls 16*a* and 16*b* extending perpendicularly from the places along the edges of the center opening 17 of the push-plate 16 and having their bottom edges inserted through the opening 85 of the inner casing 80 and completely engaged with the tapered faces 80*a* and 80*b*, respectively, formed on the back side of the inner casing 80 in the state that the stoppers of the actuating rods are touched to the inner wall of the box-shaped members. When, for example, the R-marked portion of the push-plate 16 is depressed, the bottom edge of the perpendicular wall 16*b* on the back of the R-marked portion of the push-plate 16 completely departs from the tapered face 80*b* on the back of the inner casing and rotates about the position S where the, perpendicular wall 16*a* on the L-marked portion side of the push-plate is completely engaged with the tapered face 80*a* on the back of the inner casing. By means of the above, the R-marked portion side of the push-plate 16 descends by a stroke l, and the tilted face of the actuating rods 100 and 106 corresponding to the R-marked portion descends while pressing the circumferential face of the bridge members 25 and 55, respectively. At that time, the bridge members 25 and 55 are elastically deformed, and their respective slide contacts depart from the stationary contacts 21 and 51 and touch the stationary contacts 22 and 52, respectively. In that process, the slide contact of the bridge member 55 moves earlier than the slide contact of the bridge member 25 moves. Similarly, when the L-marked portion of the push-plate 16 is depressed, the bottom edge of the perpendicular wall 16*a* of the push-plate 16 completely departs from the tapered face 80*a* and rotates about the position where the perpendicular wall 16*b* on the R-marked portion side is completely engaged with the tapered face 80*b*, and the L-marked portion side of the push-plate 16 descends by the stroke l and presses the actuating rods 102 and 104. By the above, the corresponding bridge members 35 and 45 are elastically deformed, and the slide contact of the bridge member 45 departs from the stationary contact 41 and touches the stationary contact 42**.

Further, in case the U-marked portion or D-marked portion of the push-plate 16 is depressed, the perpendicular walls **16*a* and 16*b* of the push-plate rotate in the state that the edge from the box-shaped member 82 or 81 is engaged with the tapered faces 80*a* and 80*b*. By the above, the U-marked portion side or D-marked portion side of the push-plate 16 descends by the stroke l, and the tilted face of the actuating rods 100 and 102 corresponding to the U-marked portion or the tilted face of the actuating rods 104 and 106 corresponding to the D-marked portion descends while pressing the circumferential face of the bridge members 25 and 35 or the bridge members 45 and 55, respectively. At that time, the bridge members 25 and 35 are elastically deformed, the slide contact touched to the stationary contact 21 touches the stationary contact 22, the bridge members 45 and 55 are similarly elastically deformed, their respective slide contacts depart from the corresponding stationary contacts 41 and 51 and touch the corresponding stationary contacts 42 and 52, respectively. In that process, because the distance b between the stationary contacts 41 and 42 and the distance c between the stationary contacts 51 and 52 are selected to be $c<b$, the slide contact of the bridge member 55 moves earlier than the slide contact of bridge member 45. In case of this preferred embodiment, the stationary contacts 30 and 31 and the bridge member 35 are not used as component elements of a control circuit for switching as will be described later but are used as dummies for well-balanced operability of the push-plate 16. Practically, the symmetrical arrangement of the four bridge members and four actuating rods is very important in the above-mentioned sense, and the driver feeling a substantially equal pressure when pressing any of the R-, L-, U- and D-marked portions of the push-plate 16 is helpful for safe driving. Tactile feeling is required as the driver's feel at the time of pressing the push-plate 16, and from such point of view, it is necessary to appropriately shape the tilted face of each actuating rod. The tactile feeling, namely, the touch that the driver is let to feel because when the push-plate 16** as pressed descends more than a certain distance, the force to push up the push-plate of the corresponding bridge members decreases, may be provided by shaping each actuating rod so that the angle at which the tilted face of the actuating rod touches the circumferential face of the corresponding bridge member, namely, the angle of the tangential plane with respect to the circuit board, may vary gradually within 45 deg. beginning from the tip of the actuating rod. The spring pressure W of one bridge member is given as $W=kl/\tan\theta$, the force $P_1$ of one bridge member pushing up the push-plate is given as $P_1=W\cdot\sin\theta\cdot\cos\theta$, and the force p to push the push-plate is given as $p=2(P_1+r)=2r+kl\cdot\cos^2\theta$, where $\theta$ is the angle of the circumferential face of the bridge member with respect to the circuit board at the point where the circumferential face touches the actuating rod, r is the frictional force between the circuit board and bridge member or between the actuating rod and bridge member, k is the spring constant of the bridge member, and l is the distance (stroke) the push-plate descends. The value of $\theta$ needs to be 45 deg. or less, and if the value of $\theta$ is greater than 45 deg., the value of r will be large, which is undesirable.

Figure 7:
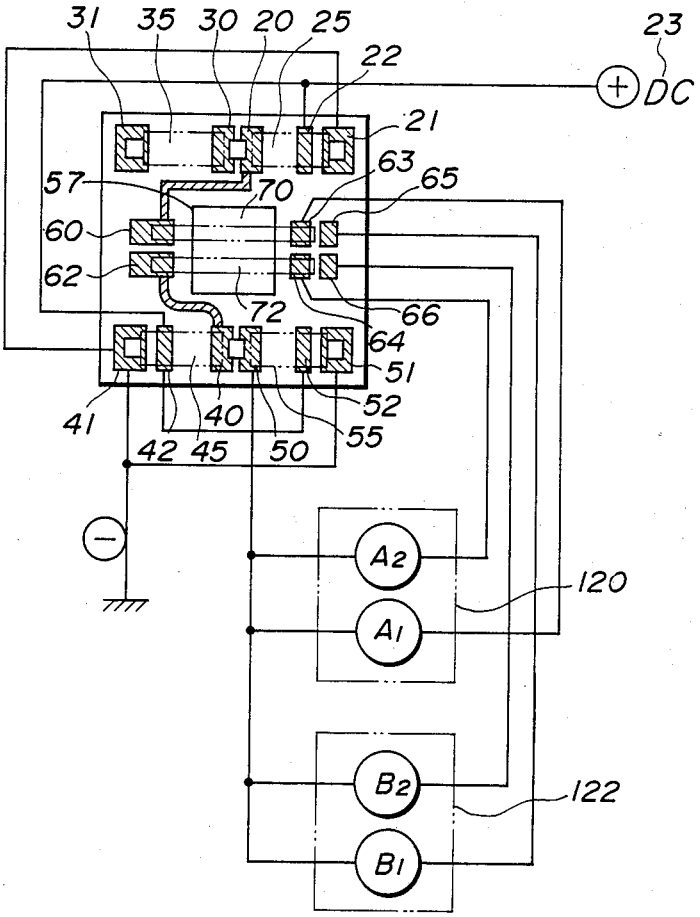
Figure 8:
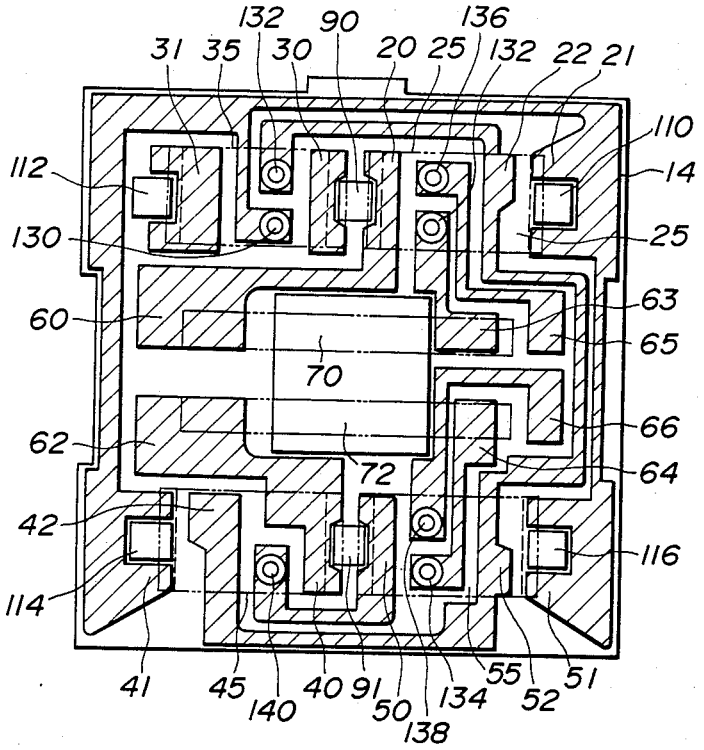

A control switch according to the present invention comprises a control circuit as shown in FIG. 7 for regulating mirror motions. Of paired stationary contacts 21 and 22, paired stationary contacts 41 and 42 and paired stationary contacts 51 and 52, the stationary contacts 21, 41 and 51 are connected to the negative pole of a power source 23, and the stationary contacts 22, 42 and 52 are connected to the positive pole of the power source. A stationary contact 20 which corresponds to the paired stationary contacts 21 and 22 is connected to a stationary contact 60 and is selectively connected to a stationary contact 63 or 65 through a slide member 70. The stationary contact 63 is connected to one of the terminals of a motor $A_1$ provided for moving about a horizontal axis the mirror 120 installed on the left side of an automobile, and the stationary contact 65 is connected to one of the terminals of a motor $B_1$ provided for moving about a horizontal axis the mirror 122 installed on the right side of the automobile. A stationary contact 40 which corresponds to the paired stationary contacts 41 and 42 is connected to a stationary contact 62 and is selectively connected to a stationary contact 64 or 66 through a slide member 72. The stationary contact 64 is connected to one of the terminals of a motor $A_2$ provided for moving about a vertical axis the mirror 120 installed on the left side of the automobile, and the stationary contact 66 is connected to one of the terminals of a motor $B_2$ provided for moving about a vertical axis the mirror 122 installed on the right side of the automobile. Further, a stationary contact 50 which corresponds to the paired stationary contacts 51 and 52 is connected to the other terminal of the motors $A_1$, $A_2$, $B_1$ and $B_2$ in common. These connections are preferably provided by forming a printed circuit pattern on a circuit board as shown in FIG. 8. Connection to the negative pole of the power source 23 is provided through a terminal 130, and connection to the positive pole of the power source is provided through a terminal 132. Connection of the stationary contacts 63, 64, 65 and 66 to one of the motor terminals is provided through terminals 132, 134, 136 and 138, respectively, and connection of the stationary contact 50 to the other motor terminal is provided through a terminal 140. These terminals 130, 132, 134, 136, 138 and 140 are embedded in the holder 15, one end of each of these terminals is fitted in a hole formed at the corresponding position of the circuit board, and the other end is connected to the negative or positive pole of the power source or a terminal of the motors.

A control switch according to the present invention is provided with a changeover switch 18 to be described below for selecting either one of the mirrors on the right and left sides of the automobile in order to subsequently move the mirror thus selected.

Figure 5:
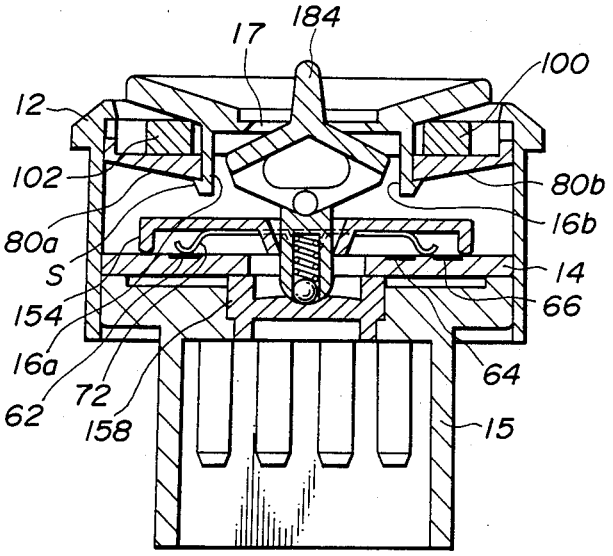

The changeover switch 18 is rotatably mounted on a support 150 which is fixed to a holder 15. The support 150 is provided with a pair of ribs 152, the ribs 152 are inserted through a center opening 160 of a circuit board 14 to project on the stationary contact provided side of the circuit board 14, and a pair of projections formed on the main part of the changeover switch 18 is supported in a pair of small holes in the ribs 152. Slide members 70 and 72 are contained in the two long narrow sections formed in a slider 154 so that the two slide members 70 and 72 may move simultaneously when the slider 154 moves. The slider 154 is provided with an opening 156 at about the center, the shaft of the changeover switch 18 is inserted through this opening, and the bottom end of the shaft is movably engaged with a guide 158 which is fixed to the holder 15. A coiled compression spring 181 and a ball 182 are provided inside the shaft 180, and part of the ball 182 is supported in a state of projecting to some extent from the bottom of the shaft 180 to outside. Further, a slit 183 is formed at the tip of the shaft 180 and engaged with the guide 158 that is fixed to the support 150. FIG. 5 shows a state that the changeover switch is in the neutral position, having the ball 182 pushed inside the shaft 180 against the elastic force of the coiled spring 181 and having the ball 182 partially touched to the guide 158. The changeover switch 18 is provided with a manipulating knob 184, which is inserted through the center opening 85 of the inner casing 80 and externally projecting from the center opening 17 of a push-plate 16. As the manipulating knob 184 is turned from the neutral position to the R-marked portion side of the push-plate 16, the shaft 183 pushes the opening wall of the slider 154, and the slider 154 slides to the L-marked portion side; as the manipulating knob 184 is turned from the neutral position to the L-marked portion side, the slider 154 slides to the R-marked portion side. At that time, the stationary contacts 60 and 62 are connected to the stationary contacts 63 and 64 or stationary contacts 65 and 66, respectively.

An electric circuit to be used with a control switch according to the present invention operates as will be explained below.

Firstly, in case of moving the mirror 120 installed on the left side of the automobile, the manipulating knob 184 of the changeover switch 18 is turned to the R-marked portion side of the push-plate 16. By so doing, the stationary contacts 60 and 62 are connected to the stationary contacts 63 and 64, respectively. As the stationary contacts 60 and 62 are connected to one of the terminals of the motors $A_1$ and $A_2$, respectively, the terminal is connected to the negative pole of the power source 23. As the stationary contact 50 is always connected to the other terminal of the motors $A_1$, $A_2$, $B_1$ and $B_2$ in common, the other terminal of the motors $A_1$ and $A_2$ is connected to the negative terminal of the power source 23. In the above condition, all the terminals of the motors $A_1$ and $A_2$ are connected to the negative terminal of the power source 23.

By subsequently pressing one of the marked portions of the push-plate 16, either one of the motors $A_1$ and $A_2$ can be rotated in the forward or reverse direction.

Figure 11:
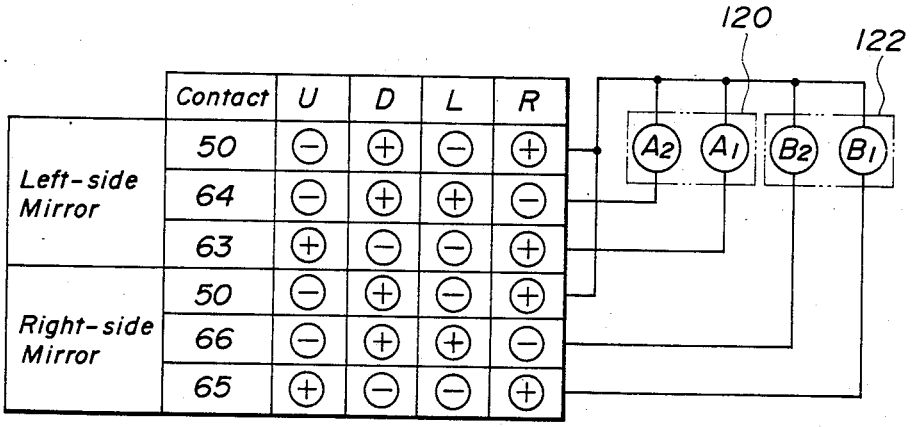
Figure 9:
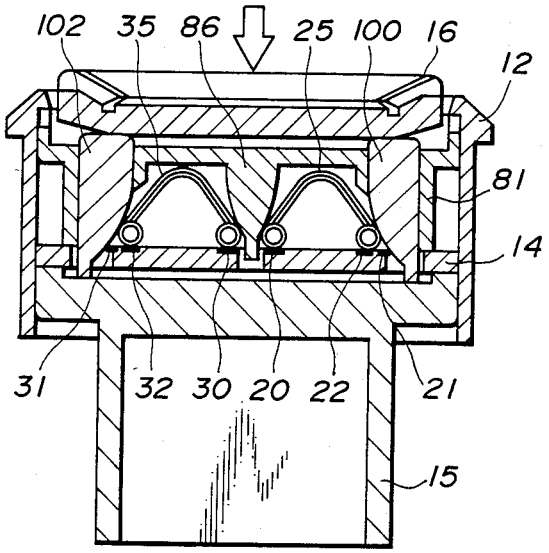

For example, if the U-marked portion of the push-plate is pressed in the direction of the arrow in FIG. 9, the actuating rods 100 and 102 descend, the actuating rod 100 causes the bridge member 25 to be elastically deformed, and the stationary contact 20 is connected to the stationary contact 22 connected to the positive pole of the power source 23. Therefore, as shown in FIG. 11, the stationary contact 63 connected to one of the terminals of the motor $A_1$ is held at a positive potential, the stationary contact 64 connected to one of the terminals of the motor $A_2$ is held at a negative potential, and the stationary contact 50 connected to the other terminal of the motors $A_1$ and $A_2$ in common is held at a negative terminal, and as a result, a current from the stationary contact 63 toward the stationary contact 50 flows to the motor $A_1$ to rotate the motor $A_1$ in the forward direction for thereby tilting the mirror 120 upwardly. Since the two terminals of the motor $A_2$ are held at a negative potential, the motor $A_2$ does not operate. If the D-marked portion of the push-plate is next pressed, the corresponding actuating rods 104 and 106 cause the bridge members 45 and 55 to be elastically deformed. At that time, the stationary contacts 40 and 50 are both connected to the stationary contacts 42 and 52, respectively, which are connected to the positive pole of the power source 23, but the slide contact of the bridge member 55 moves earlier than the slide contact of the bridge member 45. This difference in timing is very important, and if the slide contact of the bridge member 45 moved earlier than the slide contact of the bridge member 55, there would be a potential difference between the terminals of the motors $A_1$ and $A_2$, and there would be the possibility of the motor $A_2$ also rotating within the duration from the time the slide contact of the bridge member 45 moved to the time the slide contact of the bridge member 55 touched the stationary contact 52. The stationary contact 63 connected to one of the terminals of the motor $A_1$ is held at a negative potential, the stationary contact 64 connected to one of the terminals of the motor $A_2$ is held at a positive potential, and the stationary contact 50 is also held at a positive terminal; therefore, a current from the stationary contact 50 toward the stationary contact 63 flows to the motor $A_1$ to rotate the motor $A_1$ in the reverse direction for thereby tilting the mirror 120 downward. Since the two terminals of the motor $A_2$ are held at the same positive potential, the motor $A_2$ does not operate.

If the L-marked portion of the push-plate is next pressed, the corresponding actuating rods 102 and 104 are moved, the bridge members 35 and 45 are elastically deformed, and the stationary contact 40 is held at a positive potential.

Figure 10:
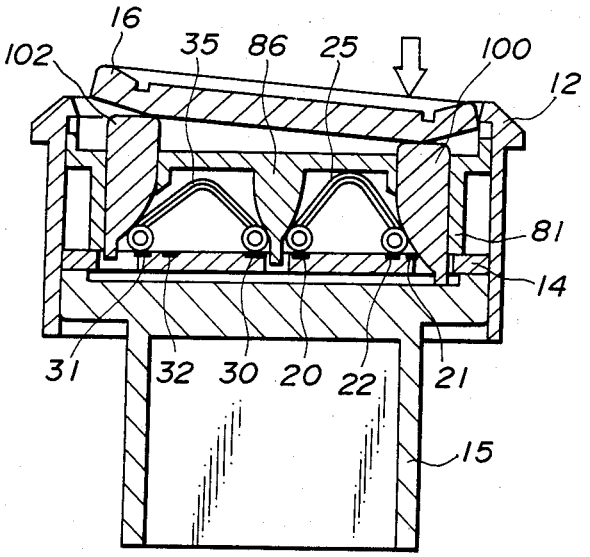

As a result, the stationary contact 63 is held at a negative potential, the stationary contact 64 is held at a positive potential, and the stationary contact 50 is held at a negative potential; therefore, a current from the stationary contact 64 toward the stationary contact 50 flows to the motor $A_2$, and the motor $A_2$ rotates in the forward direction to tilt the mirror 120 leftward. The motor $A_1$ does not operate because the two terminals of the motor $A_1$ are at the same negative potential. It should be noted that when the U- or D-marked portion of the push-plate is pressed, the bridge member 35 is elastically deformed but does not contribute to the switching operation since it is a dummy then. If the R-marked portion of the push-plate is pressed in the arrow direction in FIG. 10, the actuating rods 100 and 106 cause the bridge members 25 and 55 to be elastically deformed. At that time, the slide contact of the bridge member 55 moves earlier than the slide contact of the bridge member 25. This difference in timing as important as its counterpart in case of the bridge members 45 and 55. The stationary contact 63 is held at a positive potential, the stationary contact 64 is held at a negative potential, and the stationary contact 50 is held at a positive potential; therefore, a current from the stationary contact 50 toward the stationary contact 64 flows to the motor $A_2$ a a result, and the motor $A_2$ rotates in the reverse direction to tilt the mirror 120 rightward. The mCotor $A_1$ does not operate because the two terminals of the motor $A_1$ are at the same positive potential.

In case the mirror 122 installed on the right side of the automotive body will be moved, the manipulating knob 184 of the changeover switch 18 is turned to the L-marked portion side of the push-plate 16. By so doing, the stationary contacts 60 and 62 are connected to the stationary contacts 64 and 65, respectively. The mirror 122 can be moved thereafter in the same manner as described before regarding the mirror 120 installed on the left side.

By means of a control switch according to the present invention, a selected mirror can be moved only for the duration for which any one of the U-, D-, L- and R-marked portions of the push-plate 16 is depressed, and by providing a neutral position as shown in FIG. 5 and holding the manipulating knob 184 at the neutral position, the mirror-driving motors can be made not to operate if one of the marked portions of the push-plate is depressed by accident or by mistake.

The preferred embodiment described in the foregoing has four bridge members symmetrically arranged; however, since the stationary contacts 30 and 31 are independent of and electrically isolated from other stationary contacts and the power source, similar switching operations can be accomplished by providing the stationary contact 20 at the place of the stationary contact 31 and forming the bridge member 25 substantially twice as large in size without providing the stationary contacts 30 and 31.

Figure 12:
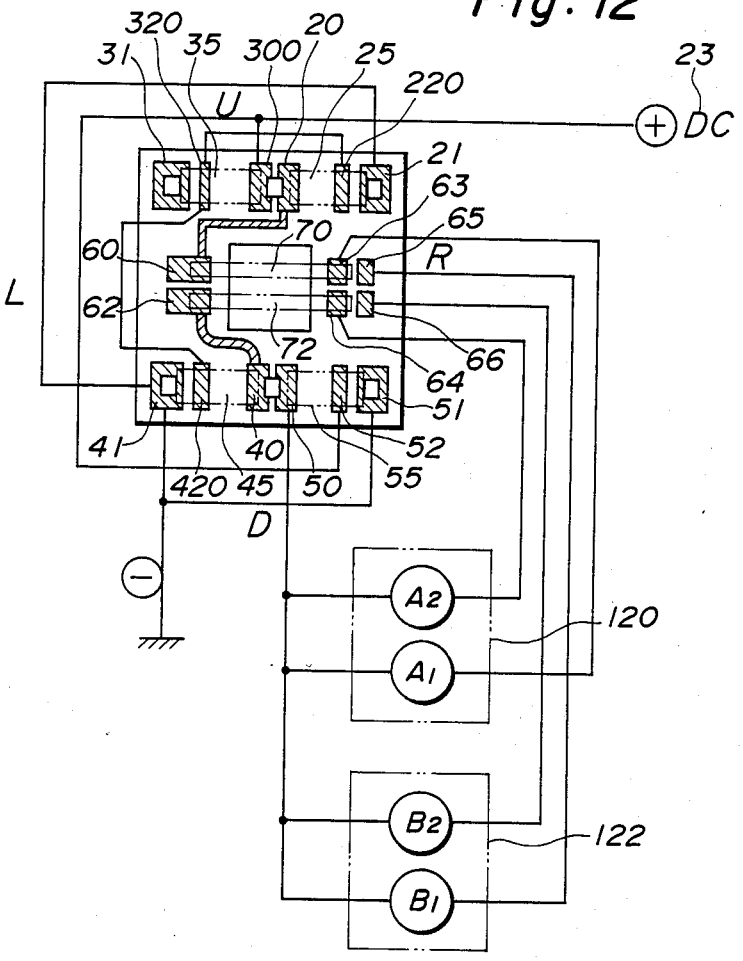
FIG. 12 is a schematic circuit diagram showing the control circuit of another control switch preferably embodied according to the present invention.

Another preferred embodiment of the control circuit due to a control switch according to the present invention is shown in FIG. 12. In FIG. 12 and the description below explaining the embodiment, the same reference numerals and symbols as those used for explaining the first preferred embodiment denote parts identical with or similar to their counterparts of the first embodiment.

A stationary contact 21 and a stationary contact 220 are provided so as to correspond to a stationary contact 20, and a bridge member 25 is provided so as to selectively connect the stationary contact 20 to the stationary contact 21 or 220 according to the non-operation or operation of an actuating rod 100.

A stationary contact 300 is connected to the positive pole of a power source 23, a stationary contact 320 and a dummy stationary contact 31 are provided in correspondence to the stationary contact 300, and a bridge member 35 is provided so as to selectively connect the stationary contact 300 to the stationary contact 320 or 31 according to the non-operation or operation of an actuating rod 102.

A stationary contact 41 and a stationary contact 420 are provided in correspondence to a stationary contact 40, and a bridge member 45 is provided so as to selectively connect the stationary contact 40 to the stationary contact 41 or 420 according to the non-operation or operation of an actuating rod 104.

The stationary contacts 220, 320 and 420 are electrically connected one another.

A stationary contact 51 and a stationary contact 52 are provided in correspondence to a stationary contact 50, and a bridge member 55 is provided so as to selectively connect the stationary contact 50 to the stationary contact 51 or 52 according to the non-operation or operation of an actuating rod 106.

This preferred embodiment has the stationary contacts 220 and 420 at places corresponding to the stationary contacts 22 and 42 connected to the positive pole of the power source 23 in case of the first preferred embodiment, has the stationary contact 300, which is connected to the positive pole of the power source 23, at a place corresponding to the dummy stationary contact 30 in case of the first preferred embodiment, and further has the stationary contact 320, which is electrically connected to the stationary contacts 220 and 420, in correspondence to the stationary contact 300.

In case the bridge member 35 of the embodiment composed as above is operated by the actuating rod 102, that is, the U-marked portion or L-marked portion of the push-plate 16 is depressed, the stationary contacts 220, 320 and 420 are connected to the positive polarity of the power source 23, and in case the D- or R-marked portion of the push-plate 16 is depressed, the stationary contacts 220, 320 and 420 are electrically isolated.

The above implies that in case any one of the U-, D-, R- and L-marked portions of the push-plate 16 is depressed, it does not occur that two of the three stationary contacts 20 (or 63), 40 (or 64) and 50 to be connected to motor terminals are both connected to the positive polarity of the power source, and no potential difference develops between the terminals of other motors than the required one even if, in case the D- or R-marked portion of the push-plate 16 is depressed and the bridge member 55 moves from ordinary position to actuated position later than the bridge member 45 or 25. FIG. 13 shows the polarities of the stationary contacts 63 (or 20), 64 (or 40) and 50 in case the U-, D-, R-and L-marked portions of the push-plate 16 are pressed, and the required motor is rotated in the required direction regardless of the timing of the connection between stationary contacts due to each bridge member, which ensures improvement in switching performance.

What is claimed is:

1. A control switch for remote-control of the movement about a horizontal axis and a vertical axis, one at a time, of a right mirror and left mirror, which are rotatably supported on an automobile and moved by motors, said control switch comprising:

(a) a holder;

(b) a circuit board mounted on said holder;

(c) a changeover switch for selecting either one of said light and left mirrors to be moved, mounted on said holder;

(d) first and second stationary contacts provided on said circuit board to be selectively connected through said changeover switch to a first terminal of said motors for moving said right and left mirrors about said horizontal or vertical axes;

(e) a third stationary contact provided on said circuit board connected in common to a second terminal of each of said motors;

(f) first to third stationary contact pairs provided on said circuit board, each stationary contact pair comprising two stationary contacts to be connected to the negative and positive polarities of an electrical power source, respectively;

(g) first to third bridge members formed of an electrically conductive elastic material, for selectively connecting said first to third stationary contacts to either one of the two stationary contacts comprising said first to third stationary contact pairs, respectively;

(h) an enclosure fixedly connected to said circuit board, to retain said first to third bridge members so that said first to third stationary contacts are normally connected to said stationary contacts of said first to third stationary contact pairs that are connected to the negative polarity of said electrical power source through asid first to third bridge members, said first to third bridge members being movably retained within said enclosure such that a first end of said first to third bridge members is slidable;

(i) actuating rods, independent of one another, provided within and movable with respect to said enclosure, having a first end in contact with said first end of said first to third bridge members, respectively, and having a second end projecting outward from said enclosure;

(j) a push-plate supported by said second ends of said actuating rods, for selectively engaging said actuating rods to move said slidable end of said first to third bridge members froma normal position to an actuated position.

2. A control switch as in claim 1, wherein the distance between the two stationary contacts composing said third stationary contact pair is smaller than the distance between the two stationary contacts composing said second and third stationary contact pairs, respectively.

3. A control switch for remote-control of the movement about a horizontal axis and a vertical axis, one at a time, of a right mirror and left mirror, which are rotatably supported on an automobile and moved by motors, said control switch comprising:

(a) a holder;

(b) a circuit board mounted on said holder;

(c) a changeover switch for selecting either one of said right and left mirrors to be moved, mounted on said holder;

(d) first and second stationary contacts provided on said circuit board to be selectively connected through said changeover switch to a first terminal of said motors for moving said right and left mirrors about said horizontal or vertical axes;

(e) a third stationary contact provided on said circuit board connected in common to a second terminal of each of said motors;

(f) first to third stationary contact pairs provided on said circuit board, each stationary contact pair comprising two stationary contacts to be connected to the negative and positive polarities of an electrical power source, respectively;

(g) first to third bridge members formed of an electrically conductive elastic material, for selectively connecting said first to third stationary contacts to either one of the two stationary contacts comprising said first to third stationary contact pairs, respectively;

(h) a fourth bridge member formed of an electrically conductive elastic material;

(i) an enclosure fixedly connected to said circuit board, to retain said first to fourth bridge members so that said first to third stationary contacts are normally connected to said stationary contacts of said first to third stationary contact pairs that are connected to the negative polarity of said electrical power source through said first to third bridge members, respectively, said first to fourth bridge members being movably retained within said enclosure such that a first end of said first to fourth bridge members is slidable;

(j) actuating rods, independent of one another, provided within and movable with respect to said enclosure, having a first end in contact with said first end of said first to fourth bridge members, respectively, and having a second end projecting outward from said enclosure;

(k) a push-plate supported by said second ends of said actuating rods, for selectively engaging said actuating rods to move said slidable end of said first to fourth bridge members from a normal position to an actuated position.

4. A control switch as in claim 3, wherein said first and fourth bridge members are retained so that the ends of said first and fourth bridge members are on a substantially straight first line, and said second and third bridge members are held so that the ends of said second and third bridge members are on a second straight line which is parallel in positional relation to said first straight line.

5. A control switch as in claim 3, wherein the distance between the stationary contacts composing said third stationary contact pair is smaller than the distance between the two stationary contacts composing said first and second stationary contact pairs, respectively.

6. A control switch as in claim 3, wherein said enclosure is comprising a first box-shaped enclosure to accommodate said first and fourth bridge members and a second enclosure to accomodate said second and third bridge members, and the bottom edges of said first and second enclosures are in contact with said circuit board.

7. A control switch as in claim 6, wherein each of said first and second enclosure is provided with a partition wall to separate said first and fourth bridge members from each other and said second and third bridge members from each other, respectively, and each of said partition walls is provided with tilted faces which touch a circumferential face near the neighboring ends of the corresponding bridge members.

8. A control switch for remote-control of the movement about a horizontal axis and a vertical axis, one at a time, of a right mirror and left mirror, which are rotatably supported on an automobile and moved by motors, said control switch comprising:

(a) a holder;

(b) a circuit board mounted on said holder;

(c) a changeover switch for selecting either one of said right and left mirrors to be moved, mounted on said holder;

(d) first and second stationary contacts provided on said circuit board to be selectively connected through said changeover switch to a first terminal of said motors for moving said right and left mirrors about said horizontal or vertical axes;

(e) a third stationary contact provided on said circuit board connected in common to a second terminal of each of said motors;

(f) a fourth stationary contact provided on said circuit board to be connected to the positive polarity of an electrical power source;

(g) first to fourth bridge members formed of electrically conductive elastic material having a first end in contact with said first to fourth stationary contacts, respectively, and a second end being able to slide between a normal position and an actuated position;

(h) first to third stationary contact pairs provided on said circuit board comprising two stationary contacts, a first stationary contact of each of said first to third stationary contact pairs being connected to the negative polarity of said electrical power source and being in contact with a second end of said first to third bridge members when said first to third bridge members are in said normal position;

(i) a fifth stationary contact provided on said circuit board electrically connected to a second stationary contact of said first and second stationary contact pairs, said fifth stationary contact being in contact with a second end of said fourth bridge member when said fourth bridge member is in said actuated position, and said second stationary contact of said first and second stationary contact pairs being in contact with a second end of said first asnd second bridge members when said first and second bridge members are in said actuated position;

(j) a second stationary contact of said third stationary contact pair being connected to the positive polarity of said electrical power source, and in contact with said third bridge member when said bridge member is in said actuated position;

(k) an enclosure member fixedly connected to said circuit board for retaining said first to fourth bridge members;

(l) first to fourth actuating rods having a first end in contact with said second ends of said first to fourht bridge members, respectively, said actuating rods provided within and movable with respect to said enclosure member, a second end of said actuating rods projecting outward from said enclosure member;

(m) a push-plate supported by said second ends of said actuating rods, for selectively engaging said actuating rods to move said second ends of said first to fourth bridge members from a normal position to an actuated position.

* * * * *